United States Patent [19]

Oura

[11] 4,135,125

[45] Jan. 16, 1979

[54] CONSTANT VOLTAGE CIRCUIT COMPRISING AN IGFET AND A TRANSISTORIZED INVERTER CIRCUIT

[75] Inventor: Toshio Oura, Tokyo, Japan

[73] Assignee: Nippon Electric Co., Ltd., Tokyo, Japan

[21] Appl. No.: 777,853

[22] Filed: Mar. 15, 1977

[30] Foreign Application Priority Data

Mar. 16, 1976 [JP] Japan ..... 51-28352

[51] Int. Cl.[2] ..... G05F 1/56

[52] U.S. Cl. ..... 323/22 R; 307/297; 330/277

[58] Field of Search ..... 330/277; 307/297; 323/22 R, 16

[56] References Cited

U.S. PATENT DOCUMENTS

| | | | |
|---|---|---|---|
| 3,508,084 | 4/1970 | Warner, Jr. | 323/22 R |
| 3,813,595 | 5/1974 | Sheng | 323/22 R |
| 3,820,007 | 6/1974 | Schilling et al. | 307/297 |
| 3,823,332 | 7/1974 | Feryszka et al. | 323/22 R |
| 3,832,644 | 8/1974 | Nagata et al. | 323/22 R |
| 4,005,353 | 1/1977 | Yokoyama | 323/22 R |

OTHER PUBLICATIONS

"FETS-Theory & Applications Notes: No. 1", Amelco Semi-Conductor Booklet; Jun. 1962, pp. 1-7.

*Primary Examiner*—Gerald Goldberg
*Attorney, Agent, or Firm*—Hopgood, Calimafde, Kalil, Blaustein & Lieberman

[57] ABSTRACT

A constant voltage circuit comprises an IGFET for deriving an output voltage for a load from a power supply and an inverter circuit responsive to the output voltage for controlling the IGFET in a negative feedback manner to stabilize the output voltage against fluctuations in the supply voltage and the load. The IGFET may be a depletion or an enhancement MOSFET. The inverter circuit preferably comprises an enhancement and a depletion or an enhancement MOSFET. Either a resistor or another IGFET may be connected between the inverter circuit and ground. The constant voltage circuit is readily manufactured as an IC together with an IGFET circuit used as the load.

9 Claims, 17 Drawing Figures

CONSTANT VOLTAGE CIRCUIT COMPRISING AN IGFET AND A TRANSISTORIZED INVERTER CIRCUIT

BACKGROUND OF THE INVENTION

This invention relates to a transistorized constant voltage circuit. A constant voltage circuit according to this invention is specifically useful for a load comprising at least one insulated gate field effect transistor (herein called an IGFET) and no other active circuit element or elements.

An IGFET is used either in a logic circuit, for example, a NAND or a NOR circuit, or in a memory circuit as an element of a large-scale integrated circuit (an LSI). For such a circuit, a high power supply voltage level results in a decrease in a speed of operation and an increase in power consumption. A low supply voltage level gives rise to an operation error. Particularly when MOSFET's of a short channel length are used as the IGFET's in the logic and/or memory circuits to provide an integrated circuit with a small-area semiconductor chip, a minimum allowable voltage should be used in order to avoid punch through of the MOSFET's. In any event, an excellent constant voltage circuit is indispensable for such a logic and/or memory circuit. It is also necessary that a constant voltage circuit provide a stable output voltage against fluctuations in the power supply voltage and the load. Preferably, the constant voltage circuit should be readily manufactured as an LSI together with the logic and/or memory circuits. These necessities and requirements are applicable also to a transistorized constant voltage circuit for a more general load.

SUMMARY OF THE INVENTION

It is therefore an object of the present invention to provide a transistorized constant voltage circuit capable of deriving an output power for a load from a power supply with the voltage of the output power well stabilized against fluctuations in the power supply voltage and the load.

It is another object of this invention to provide a constant voltage circuit of the type described, which makes an IGFET logic or memory circuit stably operate at a low voltage level and at a high speed.

It is still another object of this invention to provide a constant voltage circuit of the type described, which may readily be manufactured as an integrated circuit together with IGFET logic and/or memory circuits.

According to this invention, there is provided a constant voltage circuit having a first and a second power supply terminal between which an electric power source is to be connected and a first and a second constant voltage terminal between which a constant voltage power is to be derived from the power source. The second power supply terminal is connected to the second constant voltage terminal. The constant voltage circuit comprises a field effect transistor having a source, a drain, and an insulated gate electrode and an inverter circuit coupled between the first and second power supply terminals and having an input and an output terminal. The drain electrode is connected to the first power supply terminal. The inverter input terminal is connected to the first constant voltage terminal and the source electrode. The inverter output terminal is connected to the insulated gate electrode.

DESCRIPTION OF THE PREFERRED EMBODIMENTS

Figure 1:
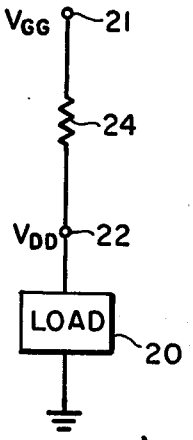
(PRIOR ART) FIG. 1
FIG. 1 shows a circuit for deriving a lower circuit output voltage from a higher power supply voltage.

Referring to FIG. 1, a prior art circuit will be described for a better understanding of the present invention. The circuit is for supplying a lower voltage $V_{DD}$ derived from a higher power supply voltage $V_{GG}$ across a load 20 and comprises a power supply terminal 21, an output terminal 22, and a resistor 24 connected between the terminals 21 and 22. The lower voltage $V_{DD}$ results as a circuit output voltage from the power supply voltage $V_{GG}$ by a voltage drop developed across the resistor 24 and is given by:

$$V_{DD} = V_{GG} - RI_L,$$

where $I_L$ represents a load current caused to flow through the load 20 and the serially connected resistor 24 of a resistance R. When the load 20 and/or the power supply voltage $V_{GG}$ fluctuate for some reason or another, the circuit output voltage $V_{DD}$ also fluctuates.

Figure 2:
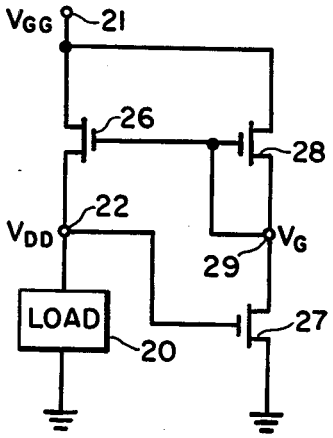
FIG. 2 shows a constant voltage circuit according to a first embodiment of the present invention.

Referring now to FIG. 2, a constant voltage circuit according to a first embodiment of this invention is for supplying an electric power to a load 20, such as an IGFET logic or memory circuit, and comprises a power supply terminal 21, a circuit output terminal 22, and a first or driver IGFET 26. The power supply terminal 21 is to be connected to an electric power supply or source indicated by a power supply voltage $V_{GG}$. The first transistor 26 has a source electrode connected to the output terminal 22 and a drain electrode connected to the power supply terminal 21. A second and a third IGFET 27 and 28 constitute an inverter circuit having an inverter input terminal connected to the output terminal 22 and an inverter output terminal 29 connected to an insulated gate electrode of the first transistor 26. The second transistor 27 has an insulated gate electrode connected to the circuit output terminal 22 and a source electrode grounded. A drain electrode of the second transistor 27 is connected to the inverter output terminal 29 and to a source electrode of the third transistor 28. A drain electrode of the third transistor 28 is connected to the power supply terminal 21. An inverter output voltage $V_G$ therefore controls the first transistor 26 as a gate voltage to make the latter supply a substantially constant circuit output voltage $V_{DD}$ across the load 20 through the circuit output terminal 22 and to make a load current $I_L$ to flow therethrough. In the example being illustrated, the first through third transistors 26–28 are a depletion, an enhancement, and a depletion MOSFET, respctively.

Figure 3:
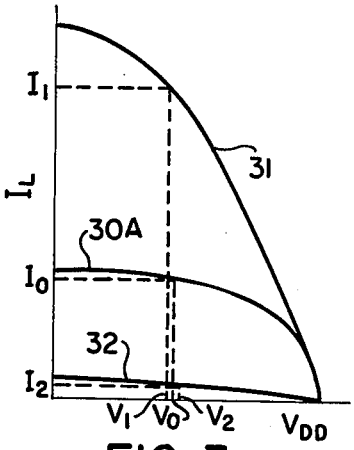
FIG. 3 shows voltage drop characteristic curves of a driver depletion MOSFET illustrated in FIG. 2 for a constant power supply voltage.
Figure 4:
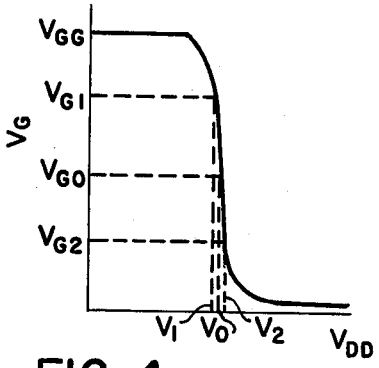
FIG. 4 shows an input-output characteristic curve of an inverter circuit illustrated in FIG. 2.
Figure 5:
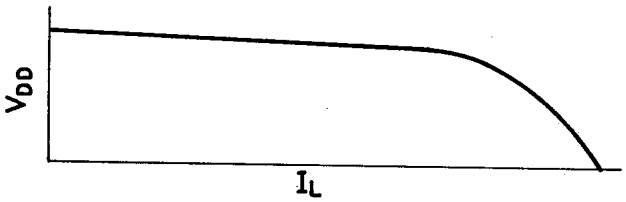
FIG. 5 shows a circuit output voltage versus load current characteristic curve of the circuit depicted in FIG. 2.

Referring to FIGS. 3 through 5, description will be made of the manner in which a constant voltage circuit illustrated with reference to FIG. 2 operates when the power supply voltage $V_{GG}$ is kept constant. It is assumed that the load current $I_L$ (FIG. 3) flowing through the load 20 and consequently through the first or driver transistor 26 takes a standard value $I_O$, when the constant voltage circuit is in a state of equilibrium with the circuit output voltage or the inverter input voltage $V_{DD}$ (FIGS. 3 and 4) held at a standard value $V_O$ and with the inverter output voltage or the first transistor gate voltage $V_G$ (FIG. 4) kept at a standard value $V_{GO}$ therefor. The voltage drop characteristic of the first transistor 26 is given by a standard curve 30A (FIG. 3).

When the load current $I_L$ increases from the standard value $I_O$ therefor to a greater value $I_1$ (FIG. 3), an increase occurs in the voltage drop developed across the first transistor 26. If the first transistor gate voltage $V_G$ were kept at the standard value $V_{GO}$, the circuit output voltage $V_{DD}$ would decrease far towards the left in FIG. 3 along the standard curve 30A. The fact is, however, that the decreasing tendency of the circuit output voltage $V_{DD}$ puts the inverter circuit into operation. As soon as the circuit output voltage $V_{DD}$ decreases to an only slightly lower value $V_1$ (FIGS. 3 and 4), the inverter circuit raises the first transistor gate voltage $V_G$ along the input-output characteristic curve to an appreciably higher value $V_{G1}$ to shift the voltage drop characteristic of the first transistor 26 to a steeper curve 31 (FIG. 3). The constant voltage circuit reaches another state of equilibrium where the circuit output voltage $V_{DD}$ is held at the slightly lower value $V_1$. When the load current $I_L$ decreases to a smaller value $I_2$, the circuit output voltage $V_{DD}$ tends to rise. No later than the circuit output voltage $V_{DD}$ rises to an only slightly higher value $V_2$, the first transistor gate voltage $V_G$ falls to an appreciably lower value $V_{G2}$ to give the first transistor 26 a less steep characteristic 32. The constant voltage circuit reaches still another state of equilibrium where the circuit output voltage $V_{DD}$ is kept at the slightly higher value $V_2$. The inverter circuit thus controls the first transistor 26 in a negative feedback fashion. As a result, the circuit output voltage $V_{DD}$ (FIG. 5) is held substantially constant against fluctuations of the load current $I_L$ unless the load current $I_L$ increases so much as to reduce the circuit output voltage and consequently the inverter input voltage $V_{DD}$ to a value that makes the input-output characteristic substantially saturate at a value approximately equal to the power supply voltage $V_{GG}$.

Figure 6:
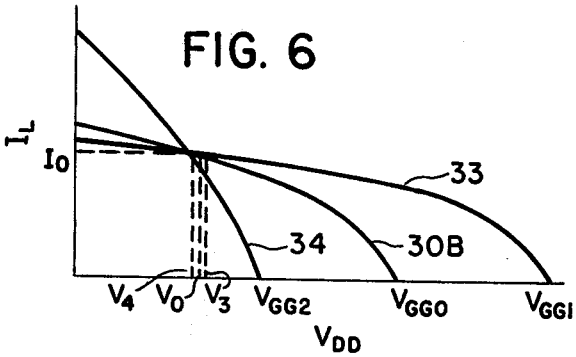
FIG. 6 shows voltage drop characteristic curves of the driver depletion MOSFET for various power supply voltages.
Figure 7:
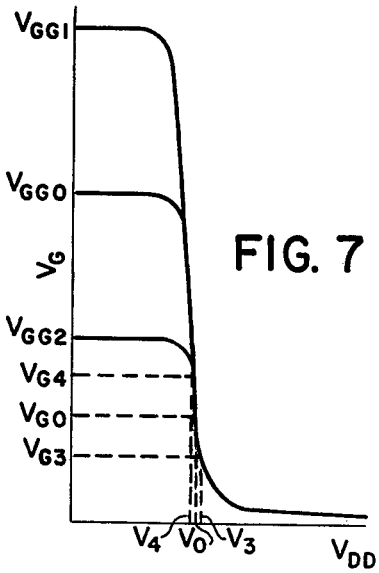
FIG. 7 shows input-output characteristic curves of the inverter circuit for various power supply voltages.
Figure 8:
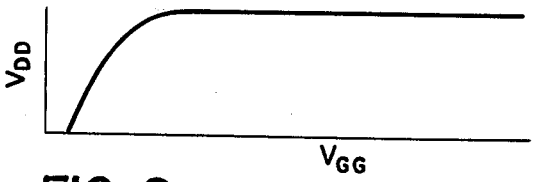
FIG. 8 shows a circuit output voltage versus power supply voltage characteristic curve of the circuit depicted in FIG. 2.

Referring to FIGS. 6 through 8, it is now presumed for a constant voltage circuit illustrated with reference to FIG. 2 that the power supply voltage $V_{GG}$ is varied. At first, let the power supply voltage $V_{GG}$ be set at a standard value $V_{GGO}$ (FIG. 6). The constant voltage circuit is in a state of equilibrium with the load or first transistor current $I_L$ and the circuit output voltage $V_{DD}$ kept at standard values $I_O$ and $V_O$, respectively, and with the inverter output voltage $V_G$ held at a standard value $V_{GO}$ therefor (FIG. 7). The voltage drop characteristic of the first transistor 26 is given by a standard curve 30B (FIG. 6). The input-output characteristic of the inverter circuit is given by a standard curve (FIG. 7) indicated therefor by a label $V_{GGO}$.

When the power supply voltage $V_{GG}$ is raised to a higher value $V_{GG1}$ (FIG. 6), the circuit output voltage $V_{DD}$ tends to rise accordingly. The inverter input-output characteristic shifts to a higher curve (FIG. 7) designated by another label $V_{GG1}$. As soon as the circuit output voltage $V_{DD}$ reaches an only slightly higher value $V_3$ (FIGS. 6 and 7), the first transistor gate voltage $V_G$ decreases to an appreciably lower value $V_{G3}$. The voltage drop characteristic of the first transistor 26 therefore shifts to a less steep curve 33 (FIG. 6). The constant voltage circuit reaches another state of equilibrium with the circuit output voltage $V_{DD}$ prevented from increasing above the slightly higher value $V_3$. When the power supply voltage $V_{GG}$ is lowered to a lower value $V_{GG2}$, the circuit output voltage $V_{DD}$ tends to fall consequently. The inverter input-output characteristic shifts to a lower curve labelled $V_{GG2}$. No later than the circuit output voltage $V_{DD}$ falls to an only slightly lower value $V_4$ the constant voltage circuit is put into still another state of equilibrium with the voltage drop characteristic shifted to a steeper curve 34 and with the circuit output voltage $V_{DD}$ kept at the slightly lower value $V_4$. A negative feedback control is again put into operation by the inverter circuit on the first transistor 26. The circuit output voltage $V_{DD}$ (FIG. 8) is kept substantially constant against fluctuations in the power supply voltage $V_{GG}$ unless the power supply voltage $V_{GG}$ is lowered below a threshold voltage $V_{TH}$ of the second transistor 27.

Figure 9:
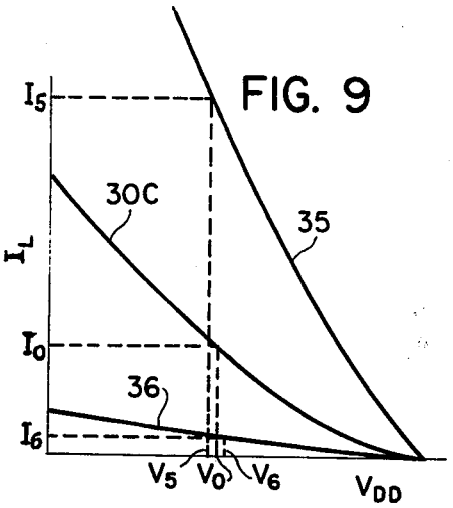
FIG. 9 shows voltage drop characteristic curves of an enhancement MOSFET used as a driver transistor illustrated in FIG. 2 for a constant power supply voltage.

Referring to FIG. 2 again and to FIG. 9 afresh, a constant voltage circuit according to a modification of the first embodiment comprises an enhancement MOSFET as the first transistor 26 instead of the depletion MOSFET (the difference in types of the MOSFET's being not depicted). It is assumed at first that the power supply voltage $V_{GG}$ is again kept constant. Let the constant voltage circuit be in a state of equilibrium where the load and first transistor current $I_L$ and the circuit output voltage $V_{DD}$ are kept at standard values $I_O$ and $V_O$, respectively. With the inverter input voltage $V_{DD}$ held at the standard value $V_O$ therefor, the inverter output voltage and therefore the first transistor gate voltage (not depicted in FIG. 9) makes the first transistor 26 have a standard voltage drop characteristic curve 30C (FIG. 9). When the load current $I_L$ grows larger to a greater value $I_5$ (FIG. 9), the circuit output voltage $V_{DD}$ tends to fall below an only slightly lower value $V_5$. The constant voltage circuit, however, arrives at another state of equilibrium due to the negative feedback control carried out by the inverter circuit on the first transistor 26, with the voltage drop characteristic raised to a steeper curve 35 and with the circuit output voltage $V_{DD}$ kept at the slightly lower value $V_5$. When the load current $I_L$ decreases to a smaller value $I_6$, the constant voltage circuit reaches still another state of equilibrium with the voltage drop characteristic shifted to a less steep curve 36 and with the circuit output voltage $V_{DD}$ held at an only slightly higher value $V_6$. The resulting characteristic is similar to that depicted in FIG. 5.

Figure 10:
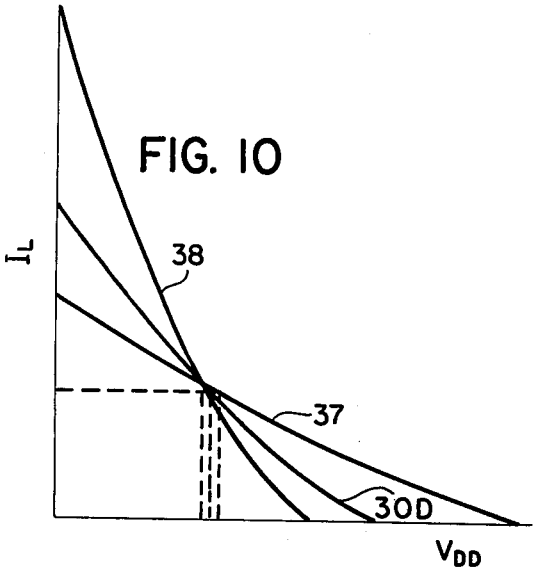
FIG. 10 shows voltage drop characteristic curves of the driver enhancement MOSFET for various power supply voltages.

Referring to FIG. 10, it is now presumed for a constant voltage circuit according to the modification described in the next preceding paragraph that the power supply voltage $V_{GG}$ is varied. At first, let the power supply voltage $V_{GG}$ be set at a standard value. The constant voltage circuit is held in a state of equilibrium where the load and first transistor current $I_L$ and the circuit output voltage $V_{DD}$ are kept at standard values therefor. The voltage drop characteristic of the first transistor 26 is given by a standard curve 30D. When the power supply voltage $V_{GG}$ is raised to a higher value, the circuit output voltage $V_{DD}$ tends to rise accordingly. The first transistor gate voltage $V_G$ therefore appreciably decreases as described with reference to FIG. 7 to shift, in cooperation with the higher power supply voltage, the voltage drop characteristic to a less steep curve 37. The constant voltage circuit reaches another state of equilibrium where the circuit output voltage $V_{DD}$ is kept at an only slightly higher value. When the power supply voltage $V_{GG}$ is lowered to a lower value, the resulting rise in the first transistor gate voltage $V_G$ moves the voltage drop characteristic to a steeper curve 38 in cooperation with the lower power supply voltage. The constant voltage circuit is put into still another state of equilibrium where the circuit output voltage $V_{DD}$ is kept at an only slightly lower value. As shown in FIG. 8, the eventual characteristic of the circuit output voltage $V_{DD}$ versus the power supply voltage $V_{GG}$ is substantially constant so long as the power supply voltage $V_{GG}$ is higher than a minimum voltage for rendering the first transistor 26 conductive, namely, than the sum of the threshold voltages $V_{TH}$ of the first and second transistors 26–27.

Figure 11:
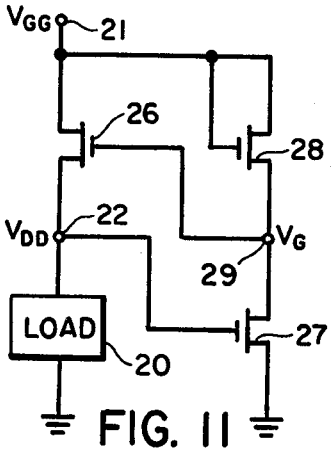
FIG. 11 shows a constant voltage circuit according to a second embodiment of this invention.

Turning to FIG. 11, a constant voltage circuit according to a second embodiment of this invention comprises an enhancement MOSFET as the third transistor 28 instead of a depletion MOSFET. Herein, the third transistor 28 has a source electrode connected to the inverter output terminal 29 and an insulated gate electrode connected to its own drain electrode and to the power supply terminal 21. By a circuit according to this embodiment, a substantially constant circuit output voltage $V_{DD}$ is also produced as by a circuit according to the first embodiment or the modification thereof.

Figure 12:
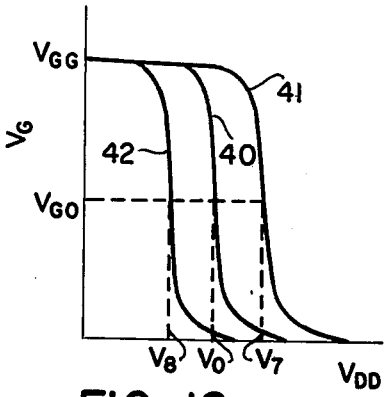
FIG. 12 shows input-output characteristic curves of an inverter circuit, such as that illustrated in FIG. 2, wherein enhancement MOSFET's used as input-side transistors, respectively, have different threshold voltages.

Referring now to FIG. 12, description will be made of the effects caused on the inverter input-outut characteristic when the threshold voltage $V_{TE}$ of the enhancement MOSFET used as the second transistor 27 varies in a constant voltage circuit exemplified in FIG. 2. Let a second transistor 27 have a threshold voltage $V_{TE}$ of a reference value, which gives a reference characteristic curve 40. If another second transistor 27 has a higher threshold voltage, the characteristic curve translates towards the right in FIG. 12 to another curve 41 by a distance substantially equal to the difference between the reference and the higher threshold voltages. As indicated at $V_7$, the circuit output voltage $V_{DD}$ rises by an amount substantially equal to the difference. When the threshold voltage $V_{TE}$ is lower, the characteristic shifts towards the left to still another curve 42 to decrease the circuit output voltage $V_{DD}$ to a lower value $V_8$. It is now understood that the circuit output voltage $V_{DD}$ is proportional to the threshold voltage $V_{TE}$ and is adjustable by a selection of the threshold voltage $V_{TE}$ of the enhancement MOSFET 27.

Figure 13:
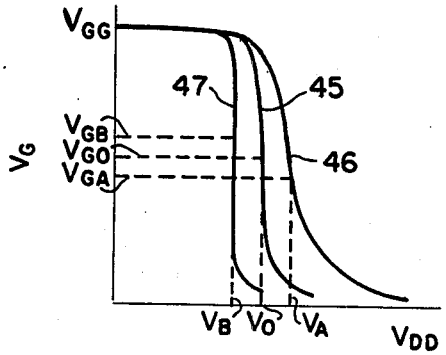
FIG. 13 shows input-output characteristic curves of an inverter circuit, such as that illustrated in FIG. 2, wherein depletion MOSFET's used as output-side transistors, respectively, have different threshold voltages.
Figure 14:
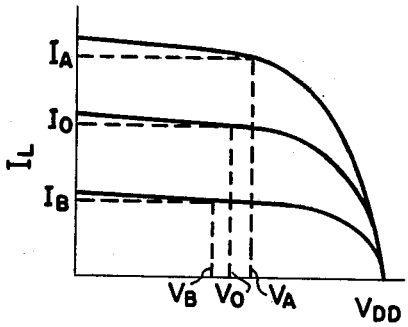
FIG. 14 shows voltage drop characteristic curves of the driver depletion MOSFET illustrated in FIG. 2 for various inverter input-output characteristic curves depicted in FIG. 13.

Referring to FIGS. 13 and 14, let consideration be given to the threshold voltage $V_{TD}$ of a depletion MOSFET which typically is the third transistor 28 in a circuit according to the first embodiment. When a third transistor 28 has a threshold voltage $V_{TD}$ of a reference value, the inverter input-output characteristic is given by a reference curve 45. For a higher threshold voltage, a threshold current $I_{TD}$ which can flow through the third transistor 28 increases accordingly. The characteristic curve shifts rightwards in FIG. 13 to another curve 46. When a load 20 comprises at least one depletion MOSFET and no other active circuit elements, the load current $I_L$ increases from a reference value $I_O$ (FIG. 14) to a greater value $I_A$ because the load current $I_L$ is proportional to the threshold current $I_{TD}$ and $V_{TD}^2$. The current which can flow through the first transistor 26 is proportional to $(V_G + V_{TD})^2$. It is now necessary that the first transistor gate voltage $V_G$ be lowered to a lower value $V_{GA}$ (FIG. 13). The circuit output voltage $V_{DD}$ takes a higher value $V_A$, which is proportional to the threshold current $I_{TD}$. With a lower threshold voltage and consequently with a smaller threshold current, the inverter characteristic moves leftwards to still another curve 47. The load current $I_L$ decreases to a smaller value $I_B$. The first transistor gate voltage $V_G$ should rise to a higher value $V_{GB}$. The circuit output voltage $V_{DD}$ decreases to a lower value $V_B$, which is again proportional to the threshold current $I_{TD}$.

A minimum voltage $V_{DDMIN}$ for putting a logic circuit comprising enhancement and depletion MOSFET's into operation is proportional to the threshold voltage $V_{TE}$ of the enhancement MOSFET and also to the threshold current $I_{TD}$ of the depletion MOSFET. It is therefore possible to make a constant voltage circuit exemplified in FIG. 2 supply a constant voltage slightly higher than the minimum voltage $V_{DDMIN}$ to a logic circuit which comprises enhancement/depletion MOSFET's and is formed together with the constant voltage circuit on a single semiconductor chip. It is known in general that a logic circuit comprising enhancement/depletion MOSFET's has a highest possible switching speed when the voltage supplied thereacross is at the lowest possible level. On the other hand, the logic circuit has been supplied with an unnecessarily higher voltage power at the cost of the speed with a conventional power supply circuit. It is now possible with a constant voltage circuit according to this invention to provide an enhancement/depletion MOS LSI operable at a highest possible switching speed. The switching speed of the LSI is proportional to the threshold current $I_{TD}$ of the depletion MOSFET. The high-speed nature of the LSI makes it possible to reduce the threshold current $I_{TD}$ and therefore to reduce the power consumption. In addition, a reduction in the threshold current $I_{TD}$ enables a high power supply voltage $V_{GG}$ required for a clock generator to be lowered. This further contributes to saving of the electric power. This invention thus makes it possible to provide a high-speed and very low power-consumption enhancement/depletion MOS LSI of a single power source. Furthermore, the low voltage nature makes it possible to use MOSFET's of a short channel length as pointed out in the preamble of the instant specification.

Figure 15:
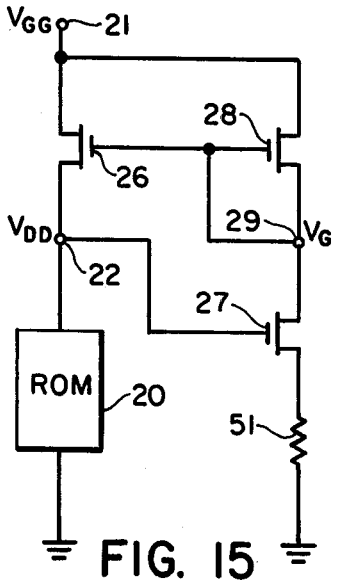
FIG. 15 shows a constant voltage circuit according to a third embodiment of this invention.

Turning to FIG. 15, a constant voltage circuit according to a third embodiment of this invention comprises similar parts designated by like reference numerals as in FIGS. 2 and 11. The source electrode of the second transistor 27, however, is coupled to ground through a resistor 51. The circuit is specifically suitable for use in supplying a constant voltage power across a read-only memory 20 (hereafter referred to as an ROM). In the known manner, an ROM comprises a memory MOSFET, a memory driving MOSFET, and a diffusion sheet resistor. The sheet resistor is connected either between the memory and the memory driving MOSFET's or between the memory driving MOSFET and ground. Alternatively, two sheet resistors may be connected between the memory and the memory driving MOSFET's and between the memory driving MOSFET and ground, respectively. A voltage drop developed across the grounded sheet resistor supplies a back bias voltage to the memory driving MOSFET to raise in effect the threshold voltage thereof. It follows therefore for an ROM 20 used as the load that the circuit output voltage $V_{DD}$ varies with the back bias voltages resulting from various manners of connection of the sheet resistors. The resistor 51 gives a back bias to effectively compensate the highest back bias voltages appearing in the ROM 20.

Figure 16:
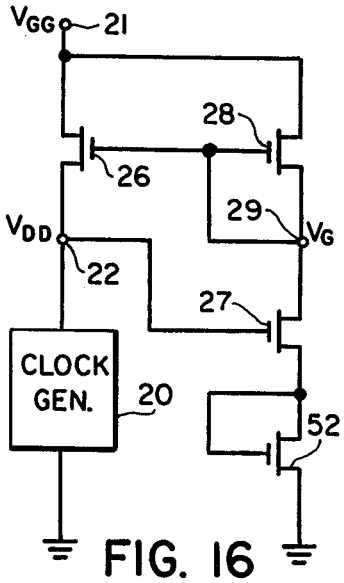
FIG. 16 shows a constant voltage circuit according to a fourth embodiment of this invention.

Referring to FIG. 16, a constant voltage circuit according to a fourth embodiment of this invention is similar to that illustrated with reference to FIG. 15 except that the circuit comprises, instead of the resistor 51, a fourth or additional field effect transistor 52 having a source, a drain, and an insulated gate electrode. Merely for convenience of illustration, let the fourth transistor 52 be an enhancement MOSFET having a threshold voltage $V_{TE}$. The source electrode is grounded. The drain and the gate electrodes are connected to the source electrode of the second transistor 27. A constant voltage circuit according to this embodiment is particularly useful when the load 20 is a clock generator. This is because the circuit output voltage $V_{DD}$ is raised by the fourth transistor 52 by a difference equal to the sum of the threshold voltage $V_{TE}$ and a voltage shift $\Delta V_{TE}$ given to the inverter input-output characteristic by a back bias provided by the fourth transistor 52.

Figure 17:
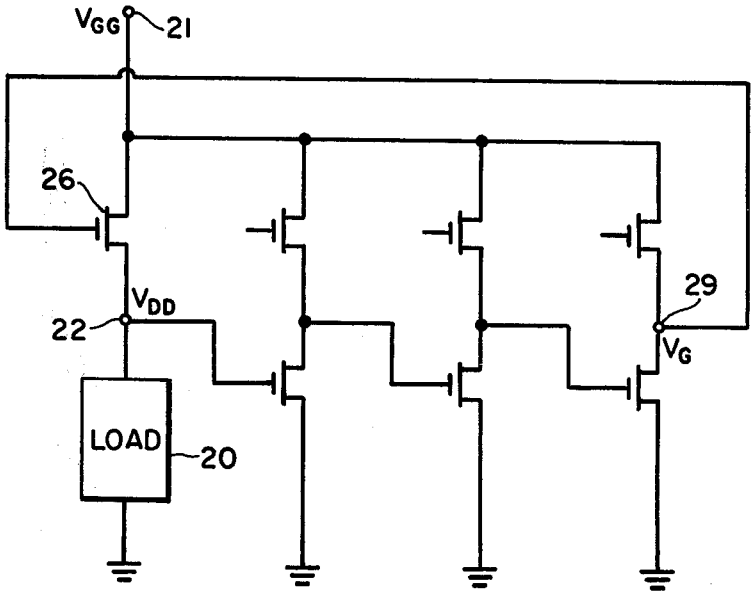
FIG. 17 shows a constant voltage circuit according to a fifth embodiment of this invention.

Referring to FIG. 17, a constant voltage circuit according to a fifth embodiment of this invention comprises an inverter circuit comprising, in turn, an odd number of inverter steps. Connection of the gate electrodes of upper IGFET's in the figure is not depicted because the connection depends on whether the upper IGFET's are of the enhancement or the depletion type. The inverter steps raise the control capability of the inverter circuit.

While this invention has thus far been described in conjunction with a few preferred embodiments thereof, it is obvious that the IGFET's used in a constant voltage circuit according to this invention are not restricted to the specific combinations of the enhancement and depletion MOSFET's exemplified hereinabove.

What is claimed is:

1. An integrated circuit for supplying an electrical signal of a substantially constant voltage to a load from an electric power source, said integrated circuit having a first and a second power supply terminal between which the electric power source is to be connected and a first and a second constant voltage terminal between which the load is to be connected, said second power supply terminal being connected to said second constant voltage terminal, said integrated circuit comprising a first field effect transistor having a first source, a first drain, and a first insulated gate electrode and a transistorized inverter circuit coupled between said first and second power supply terminals and having an input and an output terminal supplied with an inverter input voltage and an inverter output voltage respectively, said inverter circuit comprising a second field effect transistor of the enhancement type, said second field effect transistor comprising a second source and a second drain electrode respectively coupled to said second power supply terminal and said inverter output terminal, and a second insulated gate electrode connected to said inverter input terminal, the operation of said inverter being characterized by an input-output characteristic which includes first and second predetermined levels of said inverter output voltage corresponding to said inverter input voltage and a cut-off edge transitional between said first and second predetermined levels, said inverter output voltage decreasing with an increase of said inverter input voltage, said first drain electrode being connected to said first power supply terminal, said inverter input terminal being connected to said first constant voltage terminal and to said first source electrode, said inverter output terminal being connected to said first gate electrode, said inverter circuit being put into operation at said cut-off edge, thereby to supply a substantially constant voltage to the load.

2. An integrated circuit as claimed in claim 1, wherein said first field effect transistor is a metal-oxide-semiconductor field effect transistor of a depletion type.

3. An integrated circuit as claimed in claim 1, wherein said first field effect transistor is a metal-oxide-semiconductor field effect transistor of an enhancement type.

4. An integrated circuit as claimed in claim 1, wherein said inverter circuit further comprises a third field effect transistor of the depletion type, said third field effect transistor having a third source, a third drain, and a third insulated gate electrode, said second drain electrode and said third source and said third gate electrodes being connected to said inverter output terminal, said third drain electrode being connected to said first power supply terminal.

5. An integrated circuit as claimed in claim 4, wherein the source electrode of said second field effect transistor is connected directly to said second power supply terminal.

6. An integrated circuit as claimed in claim 4, wherein the source electrode of said second field effect transistor is connected to said second power supply terminal through a resistor.

7. An integrated circuit as claimed in claim 4, wherein the source electrode of said second field effect transistor is connected to said second power supply terminal through an additional field effect transistor having a source, a drain, and an insulated gate electrode, with the source electrode of said additional field effect transistor connected to said second power supply terminal and with the drain and the gate electrodes of said additional field effect transistor connected to the source electrode of said enhancement field effect transistor.

8. An integrated voltage circuit as claimed in claim 1, wherein said inverter circuit further comprises a third field effect transistor of the enhancement type, said third field effect transistor having a third source, a third drain, and a third insulated gate electrode, said second drain electrode and said third source electrode being connected to said inverter output terminal, said third drain and said third gate electrodes being connected to said first power supply terminal.

9. An integrated circuit as claimed in claim 1, wherein said inverter circuit comprises an even number of inverter stage between said second drain electrode and said inverter output terminal.

* * * * *